US005180330A

United States Patent [19]

Delepierre, Bertrand et al.

[11] Patent Number: 5,180,330

[45] Date of Patent: Jan. 19, 1993

[54] APPARATUS FOR GENERATING AT LEAST ONE JET OF GASEOUS FLUID

[76] Inventors: Delepierre, Bertrand, 65 rue de Lille, 59420 Mouvaux; Louis Coupleux, 12 rue de Verdun, 80380 Villers Bretonneux, both of France

[21] Appl. No.: 715,979

[22] Filed: Jun. 17, 1991

[30] Foreign Application Priority Data

Jun. 18, 1990 [FR] France ..... 90 07892

[51] Int. Cl.[5] ..... F24F 7/00

[52] U.S. Cl. ..... 454/64; 392/379; 34/229; 34/222; 454/66

[58] Field of Search ..... 34/210, 218, 222, 227, 34/229, 221; 15/316.1, 312.1; 392/360, 379; 57/300, 307; 454/64, 66; 98/115.4

[56] References Cited

U.S. PATENT DOCUMENTS 3,375,539 4/1968 Loepsinger ..... 15/312.1
3,777,329 12/1973 Lane ..... 15/312.1
4,642,909 2/1987 Garcia ..... 34/229

FOREIGN PATENT DOCUMENTS 942123 4/1956 Fed. Rep. of Germany ..... 98/115.1

*Primary Examiner*—Henry A. Bennet
*Assistant Examiner*—Denise L. Gromada
*Attorney, Agent, or Firm*—Kerkam, Stowell, Kondracki & Clarke

[57] ABSTRACT

An apparatus for generating at least one oriented jet of gaseous fluid that is movable in a direction substantially perpendicular to this orientation is provided, the apparatus including a hollow box (3), in particular a rectangular parallelepiped with rigid walls (3*a*), at least one flexible belt (7), which sealingly closes each aforementioned window (5) vertically of its edges (6), and which locally has at least one perforation (8) of predetermined dimensions, a driver for each belt (7) for driving the belt along the longitudinal axis (5*a*) of the window (5) vertically of which it is located, in such a manner as to displace each perforation of the belt in question along the longitudinal dimension of the window, and an injector for injecting gaseous fluid, in particular air, into the box (3) through an opening (11) made in one of its walls.

10 Claims, 2 Drawing Sheets

APPARATUS FOR GENERATING AT LEAST ONE JET OF GASEOUS FLUID

FIELD OF THE INVENTION

The invention relates to an apparatus for generating at least one oriented jet of gaseous fluid that is movable in a direction substantially perpendicular to this orientation.

More particularly but not exclusively, the invention relates to an apparatus for automatic removal of dust from mechanical subassemblies of textile machines, to prevent the accumulation of particles and/or dust, which is particularly likely to cause malfunctions.

This type of apparatus is advantageously used in removing dust from the restoring springs for heddles, to prevent clogging.

BACKGROUND OF THE INVENTION

In this field, it is known to provide blower arrangements that generate a plurality of air jets, each one located vertically of the mechanical dust protection device (French Patents 2.570.719 and 2.537.167).

These apparatuses yield good results but have the disadvantage that they are expensive to make and are voracious users of energy.

These apparatuses employ a plurality of nozzles and/or orifices that must be positioned properly on each machine involved, and they require a powerful blower system, considering the output of fluid dictated by all the nozzles and/or orifices.

Another disadvantage of these apparatuses is that they are noisy.

OBJECTS AND SUMMARY OF THE INVENTION

It is accordingly one object of the invention to provide a blower apparatus in which the noise level is diminished.

Another object of the invention is a blower apparatus that can be used directly with various machines or systems, without necessitating modification of these machines or systems.

Yet another object of the invention is an apparatus of a construction that while sturdy is less expensive. To this end, the subject of the invention is an apparatus of the aforementioned type which is characterized in particular in that it includes:

a hollow box, in particular a rectangular parallelepiped with rigid walls, the box having at least one longitudinal face including at least one window that extends over approximately the entire longitudinal dimension of the face and is constituted by at least one cutout made through the entire thickness of the wall in question, at least one flexible belt, which sealingly closes each aforementioned window vertically of its edges and which locally has at least one perforation of predetermined dimensions, a means for driving each belt along the longitudinal axis of the window vertically of which it is located, in such a manner as to displace each perforation of the belt in question along the longitudinal dimension of the window, a means for injecting gaseous fluid, in particular air, into the box through an opening made in one of its walls.

The invention will be better understood from the ensuing detailed but non-limiting description of an exemplary embodiment, taken in conjunction with the drawing.

DESCRIPTION OF THE PREFERRED EMBODIMENT

Figure 1:
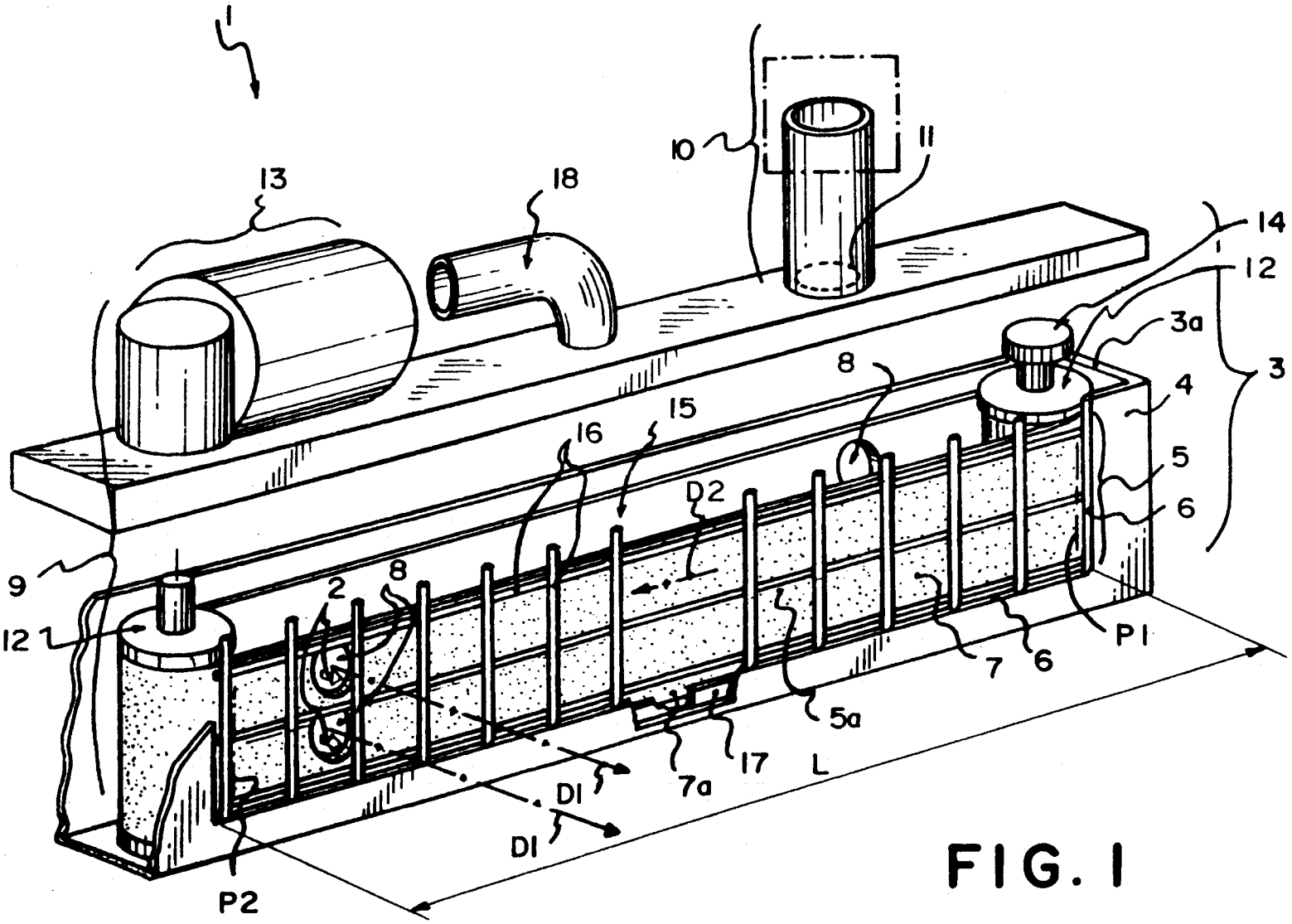
FIG. 1 is a schematic exploded perspective view of the apparatus according to the invention.

Turning to the FIG. 1, an apparatus 1 is seen that generates at least one jet 2 of gaseous fluid that is oriented in one direction D1 but is movable in a direction D2 substantially perpendicular to the direction of orientation D1.

As can be seen from the drawing, the fluid jet is movable at least between two positions P1, P2, the distance between which is determined approximately by the longitudinal dimension L of the blower apparatus.

According to the invention, the apparatus includes:

a hollow box 3, in particular a rectangular parallelepiped with rigid walls 3*a*, the box having at least one longitudinal face 4 including at least one window 5 that extends over approximately the entire longitudinal dimension of the face and which is constituted by at least one cutout made through the entire thickness of the wall in question, at least one flexible belt 7, which sealingly closes each aforementioned window 5 vertically of its edges 6, and which locally has at least one perforation 8 of predetermined dimensions, a means 9 for driving each belt 7 along the longitudinal axis 5*a* of the window 5 vertically of which it is located, in such a manner as to displace each perforation of the belt in question along the longitudinal dimension of the window, a means 10 for injecting gaseous fluid, in particular air, into the box 3 through an opening 11 made in one of its walls.

The means 10 for injecting gaseous fluid in the box comprises a blower (represented by heavy dot-dash lines), for example, which again for example is connected to the box by way of a conduit.

The expulsion of the air injected into the box is then effected via each perforation of the belt, which creates a jet having an orientation approximately perpendicular to the sector of the belt containing the orifice in question.

Accordingly, the displacement of the belt along the longitudinal axis 5*a* of the window 5 generates the displacement of each jet along a direction D2 approximately perpendicular to its orientation D1, within the boundaries of the window.

The apparatus described thus makes it possible to obtain the essential result sought by the invention, that is, a less expensive construction of a blower apparatus, in particular for removing dust from subassemblies of textile machines (not shown), which include a plurality of devices installed side by side over an elongated zone.

The apparatus according to the invention thus makes it possible, with a limited output of air, to assure the protection of a site of great longitudinal length, since on the one hand the escape of fluid is limited to the total cross-section of the perforations, which, since they extend essentially over the width of the belt in a longitudinally limited zone, discharge into the window of the box, and since on the other hand these perforations all outline the window, the longitudinal size of which is selected depending on the site.

As will be emphasized hereinafter, the apparatus of the invention employs a very simple mechanism.

Although it is not immediately apparent from the drawing, it will be appreciated that considering the mechanism used, the dimensions of the apparatus, in particular the crosswise ones, can be made small without impairing the function of the apparatus, allowing it to be integrated with machines that offer only a very narrow accommodation space.

According to the invention, on the one hand, each flexible belt 7 is of the endless type, that is, it forms a loop, and on the other hand, the means 9 for driving the belt includes at least two return and/or tension devices 12 over which the belt revolves, as well as at least one motor device 13 for controlling the rotation of at least one of its return and/or tension devices 12.

Preferably, the drive of the belt is controlled so as to be continuous in a single direction, but this is not a limiting characteristic.

The motor device 13 is a back-geared speed reducing electric motor assembly, for instance.

According to the invention, the return devices 12 comprise rollers substantially in the shape of a cylinder generated by revolution, and these rollers are each guided in rotation by a means 14 for this purpose which itself is anchored solidly to the box.

According to the invention, each window 5 past which a flexible belt 7 revolves is constituted by a single cutout made through the thickness of the wall 3*a* of the box 3 that constitutes the face in question; this window 5 is equipped with a wide-mesh grid 15, and at least some of the longitudinal and/or transverse constituent elements 16 of the grid have a bearing and sliding face 17 against which the belt 7 can press, in particular under the influence of the internal fluid pressure of the box.

According to the invention, at least one of the lateral edges 7*a* of each belt cooperates with a rectilinear guide rail 17 which is solid with the box.

Preferably, each endless belt includes at least two perforations that are spaced apart on the belt in such a manner that at least one of them is always inscribed in, or presented to, the window.

As shown, although this is understood not to limit the invention, the apparatus includes a single flexible endless belt, the width of which extends over substantially the entire width of the face of the box equipped with it.

Figure 2:
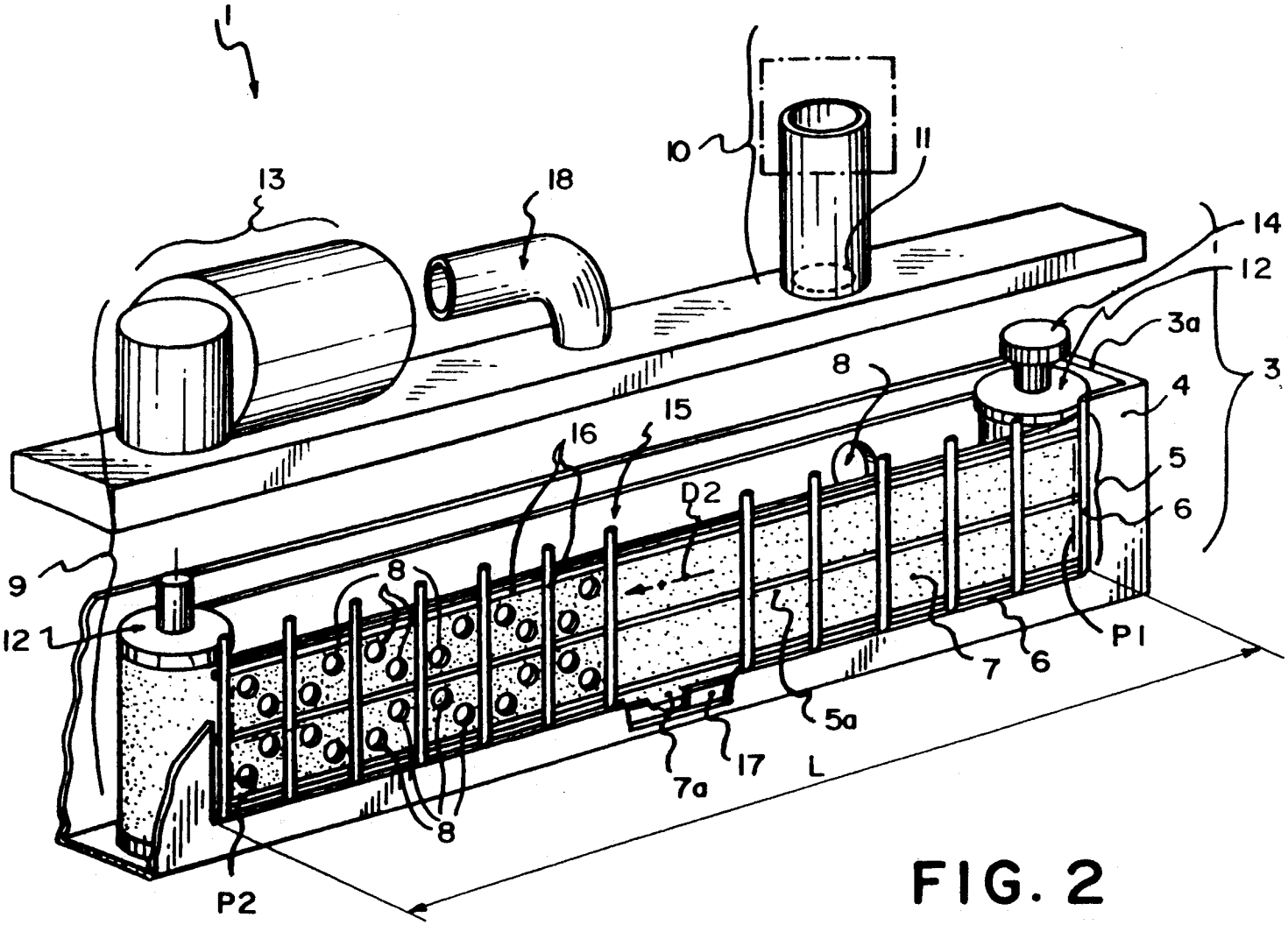
FIG. 2 is a schematic exploded perspective view of the apparatus showing an alternative preferred embodiment of the belt of the apparatus.

Also in a non-limiting manner, the belt may include at least one group of perforations disposed in a zig-zag pattern, which group extends essentially over the width of the belt as can be seen in the alternative embodiment of FIG. 2.

In a preferred embodiment, the apparatus includes at least one conduit 18 that is connected to the box and discharges toward the motor device 13.

In this way, the removal of dust from the motor device is advantageously achieved.

What is claimed is:

1. A blower apparatus (1) for generating at least one jet (2) of gaseous fluid oriented in one direction (D1) said jet also being movable in a direction (D2) substantially perpendicular to the orientation direction (D1), said blower apparatus having means for moving said at least one jet of fluid at least between two positions (P1, P2), the distance between which is approximately equal to a longitudinal dimension (L) of the blower apparatus;

the blower apparatus further comprising:

a hollow box (3), of a rectangular parallelepiped shape having rigid walls (3*a*), the box having at least one longitudinal face (4) including at least one window (5) which extends over approximately an entire longitudinal dimension of said face, said window comprising at least one cutout made through an entire thickness of a wall forming said longitudinal face, and the means for moving said at least one jet of fluid further comprising:

at least one flexible belt (7), which sealingly closes said at least one window (5), said belt being vertically disposed in a substantially parallel orientation to said window, said belt having at least one perforation (8) of predetermined dimensions, means (9) for driving said at least one belt (7) along a plane parallel to a longitudinal extent of said window (5) thereby displacing said at least one perforation of said at least one belt along the longitudinal dimension of the window, and means (10) for injecting gaseous fluid into said box (3) through an opening (11) made in one of its walls, said injecting means injecting said gaseous fluid at a side of said belt opposite a side of said belt facing said window, thereby causing said gaseous fluid to be emitted out of said box as said jet of gaseous fluid.

2. The apparatus of claim 1, wherein said at least one flexible belt (7) is of the endless type, thereby forming a loop, and said means (9) for driving said at least one belt includes at least two return devices (12), around which said belt travels, and at least one motor device (13) for controlling the rotation of at least one of said return devices (12).

3. The apparatus of claim 2 wherein said at least one window (5) past which said flexible belt (7) travels comprises a single cutout made through the thickness of the wall (3*a*) forming said longitudinal face, and said at least one window (5) further comprises a wide-mesh grid made up of longitudinal and transverse elements, and wherein a plurality of the longitudinal or transverse constituent elements (16) of the grid have a bearing and sliding face (17) against which the belt (7) can press.

4. The apparatus of claim 2 wherein said at least one endless belt includes at least two perforations which are spaced apart on said belt in such a manner that at least one of said perforations is presented to the window at all times.

5. The apparatus of claim 2 wherein said return devices (12) comprise rollers substantially in the shape of a cylinder generated by revolution, and said rollers are each guided in rotation by a guiding means (14) which is anchored solidly to the box.

6. The apparatus of claim 1 wherein at least one lateral edge (7*a*) of said at least one belt cooperates with a rectilinear guide rail (17) disposed in a fixed position in the box.

7. The apparatus of claim 1 wherein said at least one flexible belt comprises a single flexible endless belt, the width of which extends over substantially the entire width of the face of the box having said at least one window therein.

8. The apparatus of claim 1 wherein said at least one belt includes at least one group of perforations disposed in a zig-zag pattern, which group extends essentially over the width of the belt.

9. The apparatus of claim 1 further comprising at least one conduit (18) connected to the box and being adapted to discharge a portion of said gaseous fluid toward the motor device (13).

10. The apparatus of claim 2 wherein said at least one window (5) past which said flexible belt (7) travels comprises a single cutout made through the thickness of the wall (3*a*) forming said longitudinal face, and said at least one window (5) further comprises a wide-mesh grid made up of longitudinal and transverse elements, and wherein a plurality of the longitudinal and transverse constituent elements (16) of the grid have a bearing and sliding face (17) against which the belt (7) can press.

* * * * *